US011142226B2

(12) United States Patent
Dagenais et al.

(10) Patent No.: US 11,142,226 B2
(45) Date of Patent: Oct. 12, 2021

(54) LOW PROFILE GAP MITIGATION DEVICE

(71) Applicant: Westinghouse Air Brake Technologies Corporation, Wilmerding, PA (US)

(72) Inventors: Laurent Dagenais, Montreal (CA); Luc Vachon, Verdun (CA); Martin Nicole, Blainville (CA); Pierre Le Vérone, Blainville (CA); Daniel Filion, Mirabel (CA)

(73) Assignee: Westinghouse Air Brake Technologies Corporation, Pittsburgh, PA (US)

( * ) Notice: Subject to any disclaimer, the term of this patent is extended or adjusted under 35 U.S.C. 154(b) by 483 days.

(21) Appl. No.: 16/235,321

(22) Filed: Dec. 28, 2018

(65) Prior Publication Data

US 2020/0070853 A1 Mar. 5, 2020

Related U.S. Application Data

(60) Provisional application No. 62/724,254, filed on Aug. 29, 2018.

(51) Int. Cl.

| | |
|---|---|
| ***B61D 23/02*** | (2006.01) |
| ***B61K 13/04*** | (2006.01) |
| ***B61B 1/02*** | (2006.01) |

(52) U.S. Cl.

CPC ..... *B61D 23/025* (2013.01); *B61B 1/02* (2013.01); *B61K 13/04* (2013.01)

(58) Field of Classification Search

CPC ..... B61D 23/02; B61D 23/025; B61K 13/04; B61B 1/02

USPC ..... 105/443, 444, 449, 458; 104/28, 30, 31

See application file for complete search history.

(56) References Cited

U.S. PATENT DOCUMENTS

| | | | | |
|---|---|---|---|---|
| 4,068,542 | A * | 1/1978 | Brand | B61D 23/025 74/569 |
| 5,775,232 | A | 7/1998 | Golemis et al. | |
| 6,167,816 | B1 | 1/2001 | Lavery et al. | |
| 7,178,467 | B2 | 2/2007 | Le Bellec et al. | |
| 7,784,406 | B2 | 8/2010 | Chisena | |
| 7,913,628 | B2 | 3/2011 | Chisena | |
| 9,802,625 | B2 * | 10/2017 | Geddie | B61K 13/04 |
| 9,932,045 | B2 * | 4/2018 | Geddie | B61B 1/00 |
| 10,683,692 | B2 * | 6/2020 | Heidrich | E05F 15/652 |
| 10,737,703 | B2 * | 8/2020 | Sakurai | B61B 1/02 |
| 10,800,435 | B2 * | 10/2020 | Shi | B61B 1/02 |
| 2017/0327022 | A1 * | 11/2017 | Rasekhi | B60R 3/02 |
| 2021/0101533 | A1 * | 4/2021 | Brion | B60R 3/02 |

FOREIGN PATENT DOCUMENTS

| | | | | |
|---|---|---|---|---|
| GB | 193345 A * | 2/1923 | | B61D 23/02 |

* cited by examiner

*Primary Examiner* — Zachary L Kuhfuss
(74) *Attorney, Agent, or Firm* — Christopher R. Carroll

(57) ABSTRACT

A powered gap mitigation device for transit vehicles allows a gap mitigation plate to move outboard from its stowed position, be locked in the deployed position, move inboard from a deployed position to a stowed position, be locked in the stowed position, and be manually stowed and cut-out in case of malfunction.

19 Claims, 15 Drawing Sheets

LOW PROFILE GAP MITIGATION DEVICE

CROSS REFERENCE TO RELATED APPLICATIONS

This application claims the benefit of U.S. Provisional Application No. 62/724,254 filed on Aug. 29, 2018. The disclosure of this document is hereby incorporated in its entirety by reference.

BACKGROUND OF THE INVENTION

Field of the Invention

This invention is related to a Gap Mitigation Device (GMD) for transit vehicle applications. The purpose of a GMD is to fill the gap existing between a transit vehicle door threshold and the platform. GMDs are short extensions of the threshold which are stowed within the transit vehicle allowed gauge when the vehicle is in motion and deploy prior to passenger side door opening when the vehicle is stopped at the platform. GMDs bear some similarities with bridgeplates. However, bridgeplates are meant to provide an inclined ramp to overcome both a horizontal and a vertical gap between a transit vehicle floor and a station platform to allow access and egress of wheelchairs. GMDs are only meant to fill a horizontal gap between a transit vehicle threshold and a station platform. According to current ADA regulations, they allow for wheelchair access if the remaining horizontal gap after deployment of the GMD is less than 3 inches, and the vertical gap is managed by another means such as a transit vehicle air suspension. Otherwise, a GMD only prevents passengers or objects from falling in the gap between the platform and the transit vehicle doorway.

Description of Related Art

U.S. Pat. Nos. 5,775,232 and 6,167,816 describe a bridgeplate with a drive based on a lead screw and nut arrangement. While this bridgeplate shows a compact, cartridge-type layout and could be adapted to provide a GMD functionality, the manual stowage requires a relatively high force to backdrive the screw and nut arrangement along with the motor drive. It also employs the use of low friction screw and nut components. Moreover, the lever for manual stowage cannot be remotely actuated.

U.S. Pat. No. 7,178,467 describes a non-powered, passive GMD with a fixed outboard deployment length. It does not entirely fill the gap in case of gaps of different dimensions from platform to platform or from door to door in the case of curved platforms.

U.S. Pat. Nos. 7,784,406 and 7,913,628 describe a method to fill the gap which can accommodate variations in gap dimensions from platform to platform or from door to door in the case of curved platforms. However it does not provide any significant details regarding the drive and cutout mechanism arrangement.

It is an objective of the present invention to provide a mechanism featuring a simple mechanical interface for remote cutout operation, low manual effort for stowage of the gap mitigation plate and low height profile arrangement.

SUMMARY OF THE INVENTION

A powered gap mitigation device for transit vehicles allows a gap mitigation plate to move outboard from its stowed position, be locked in the deployed position, move inboard from a deployed position to a stowed position, be locked in the stowed position, and be manually stowed and cut-out in case of malfunction.

One embodiment of the invention is directed to low profile powered gap mitigation device for transit vehicles which allows a gap mitigation plate through a clutch linkage driven by a motor to move back and forth between a stowed position and a deployed position and to be locked in either position. The device has a cutout mechanism operated entirely manually. In a normal position the mechanism engages the clutch with the motor to move the plate. In a neutral position the mechanism disengages the clutch from the motor. In a cutout position the mechanism disengages the clutch from the motor and locks the plate in the stowed position.

A second embodiment is directed to a method for a low profile powered gap mitigation device for transit vehicles which allows a gap mitigation plate through a clutch linkage driven by a motor to move back and forth between a stowed position and a deployed position and to be locked in either position. The method introduces three positions of the plate using a single cutout mechanism comprising the steps of manually moving a lever to a normal position to engage the clutch with the motor to move the plate, manually moving the same lever to a neutral position to disengage the clutch from the motor, and manually moving the same lever to a cutout position to disengage the clutch from the motor and at the same time activate a first locking mechanism to lock the plate in the stowed position.

DESCRIPTION OF THE INVENTION

Figure 1:
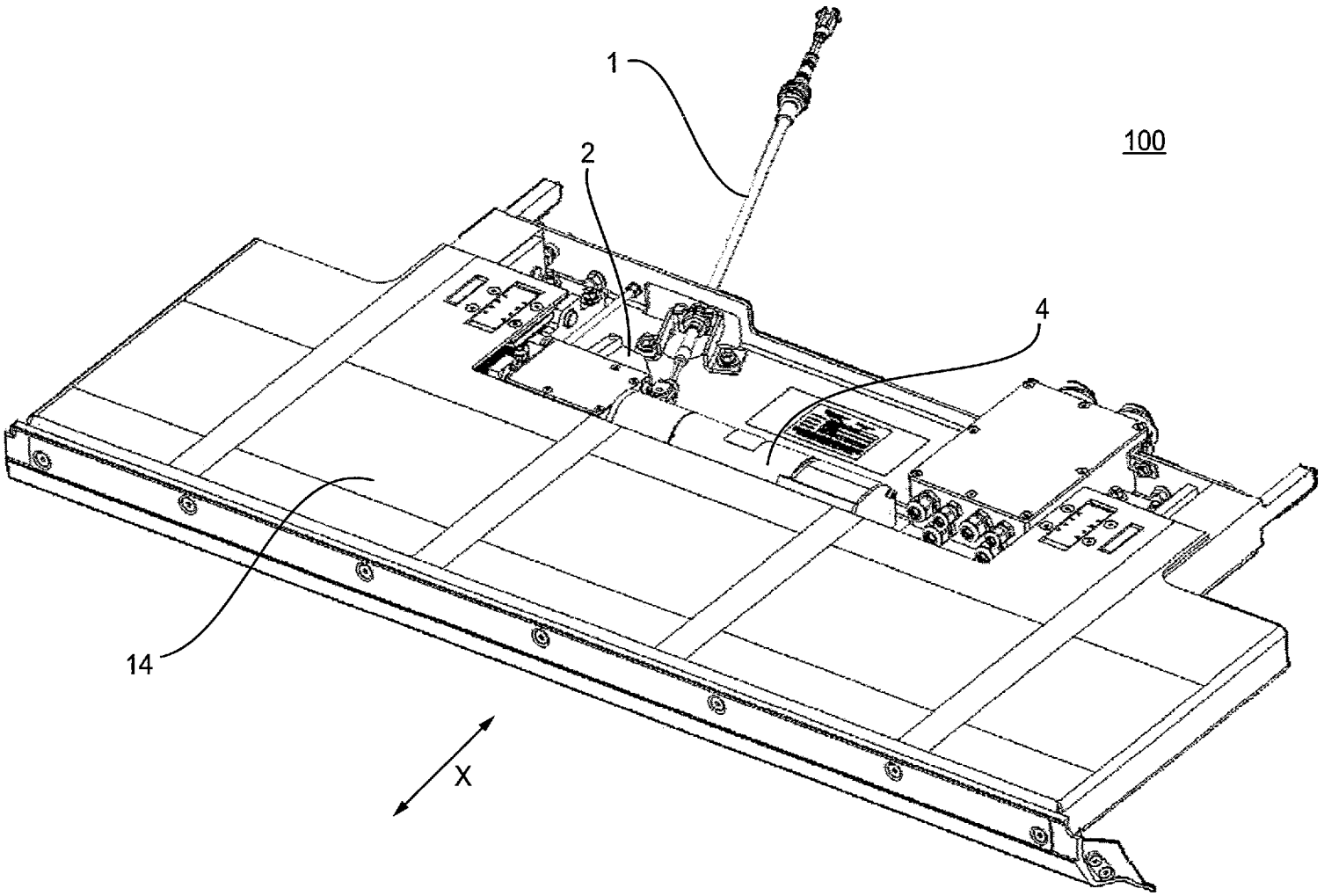
FIG. 1 shows a perspective view of the GMD with a gap mitigation plate covering the mechanism.

Directing attention to FIG. 1, a powered gap mitigation device 100 for transit vehicles allows a gap mitigation plate 14 to move outboard from its stowed position, be locked in the deployed position, move inboard from a deployed position to a stowed position, and be locked in the stowed position.

The gap mitigation device has a cutout mechanism remotely-actuated by means of a push-pull cable 1 linked to a cutout lever arm 2 with three operative positions determined by the deployed distance of the push-pull cable 1: a first position NORMAL where the cutout function is disengaged; a second position NEUTRAL where the motor assembly 4 is disengaged from the drive mechanism 9 transferring movement to the gap mitigation plate 14; and a third position CUTOUT where the gap mitigation plate 14 is locked in the stowed position. The purpose of the cutout mechanism is to lock the GMD in the stowed position in case of malfunction. The NEUTRAL position allows manual stowage of the gap mitigation plate 14 to allow its locking in the stowed position.

The push-pull cable 1 is a flexible mechanical cable connecting a three-position remotely located handle (not shown) to the cutout lever arm 2. This cable can move the cutout lever arm 2 in both directions.

The motor assembly 4 is comprised of a motor and a gear box having a high gear ratio, typically 50:1. The motor can be either a DC or a DC brushless motor.

Figure 2:
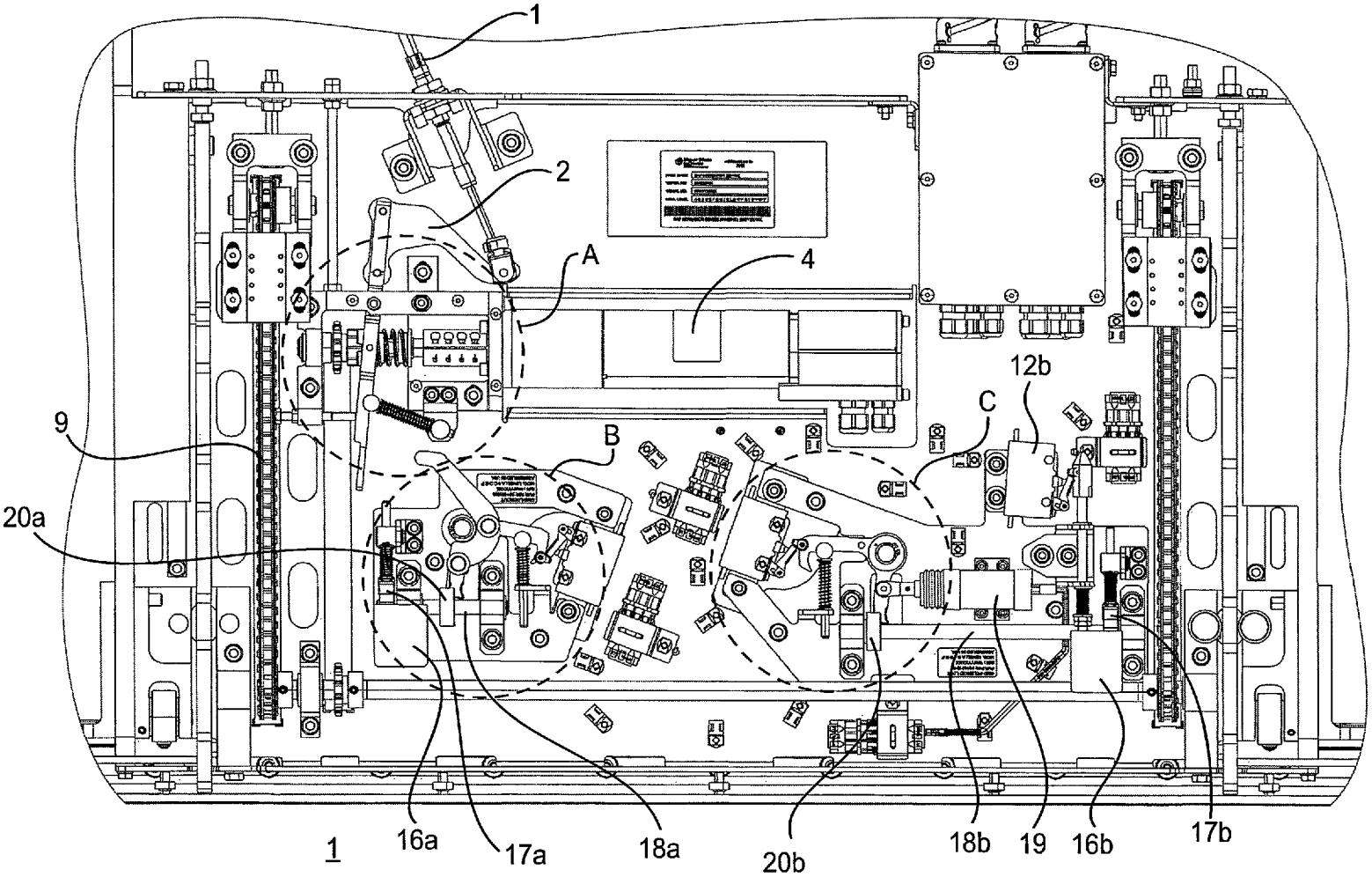
FIG. 2 shows a top view of the GMD of FIG. 1 with the gap mitigation plate removed to illustrate the working parts with the clutch mechanism generally indicated by circle "A", the first locking mechanism generally indicated by circle "B", and the second locking mechanism generally indicated by circle "C"

FIG. 2 is a plan view of FIG. 1 with selected hardware removed to show the mechanical operation. Overall, the gap mitigation plate 14 (FIG. 1) is located on top of the assembly movable inward/outward by the drive mechanism 9 coupled to the motor assembly 4 by the clutch 3. The gap mitigation device illustrated in FIG. 2 will be broadly discussed as three separate mechanisms. The clutch mechanism is highlighted by the circle labeled A, the first locking mechanism is highlighted by the circle labeled B, and the second locking mechanism is highlighted by the circle labeled C.

As an overview, the gap mitigation device includes a gap mitigation plate 14 which travels back and forth in the direction of arrow X in FIG. 1. The gap mitigation plate 14 (FIG. 1) is secured directly to a first angle member 16*a* (FIG. 2) and a second angle member 16*b*. FIG. 2 illustrates these members 16*a*, 16*b* in a position representative of the gap mitigation plate 14 in the stowed position. While the clutch mechanism A is instrumental in advancing the gap mitigation plate 14 between the stowed and deployed positions, the first locking mechanism B by restraining the first angle member 16*a* and the second locking mechanism C by restraining the second angle member 16*b* are able to lock the gap mitigation plate 14 in a stowed position. The manual push-pull cable 1 controls the cutout lever arm 2 which mechanically controls both the clutch mechanism A and the first locking mechanism B. The second locking mechanism C is not directly mechanically controlled by the push-pull cable 1, but as will be discussed, is electronically controlled using a solenoid.

Figure 3:
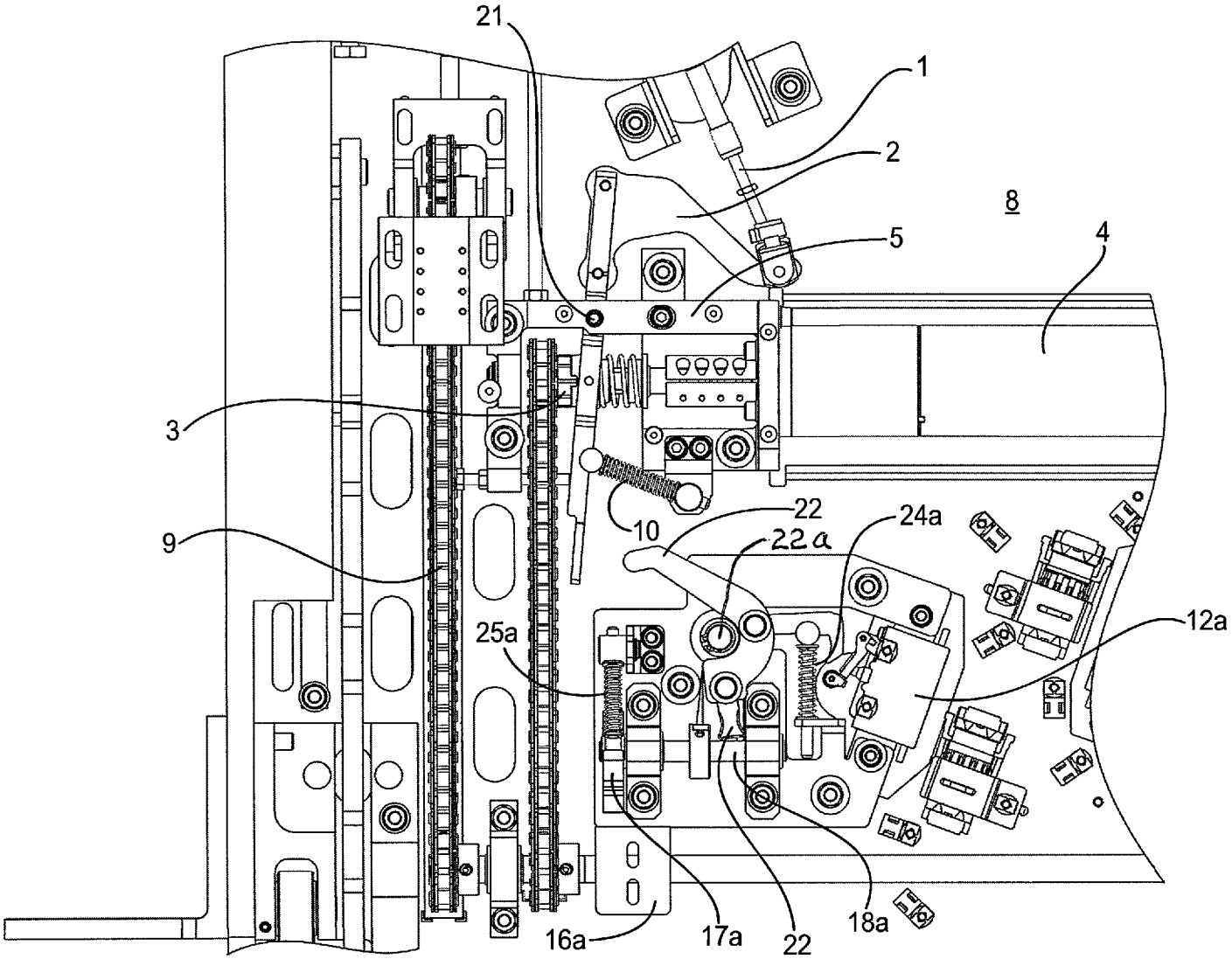
FIG. 3 shows the cutout lever in the normal position with the push-pull cable at a fully extended position, the drive mechanism clutch engaged, and the cutout lock arm disengaged.

FIG. 3 shows the device with the cutout lever arm 2 in the NORMAL position with the clutch 3 engaged and the first locking mechanism B disengaged. FIGS. 4A-4D, on the other hand, show the cutout lever 2 in the NEUTRAL position where the clutch 3 is disengaged and the first locking mechanism B is still disengaged. Directing attention to FIG. 3, the cutout lever arm 2 is rotatably mounted on a block 5 fastened to the planar mounting plate 8, with its driven side including the linkage to the push-pull cable 1 on one side of the block 5 and its driving side on the opposite side of the block 5 so that pulling on the push-pull cable 1 will cause the cutout lever arm 2 to rotate around the cutout lever arm rotation axis 21 on the block 5.

The block 5 is a fixed member fastened on the planar mounting plate 8 including the rotation axis 21, which is substantially perpendicular to the plane of the mounting plate 8.

The cutout lever arm 2 has its driving side mechanically coupled to the drive mechanism clutch 3 located between the motor assembly 4 and the rest of the drive mechanism so that an initial position of the cutout lever arm 2 driving side, corresponding to the push-pull cable 1 first position NORMAL will engage the clutch 3 and allow the motor assembly 4 to move the gap mitigation plate 14 via the drive mechanism.

Figure 4A:
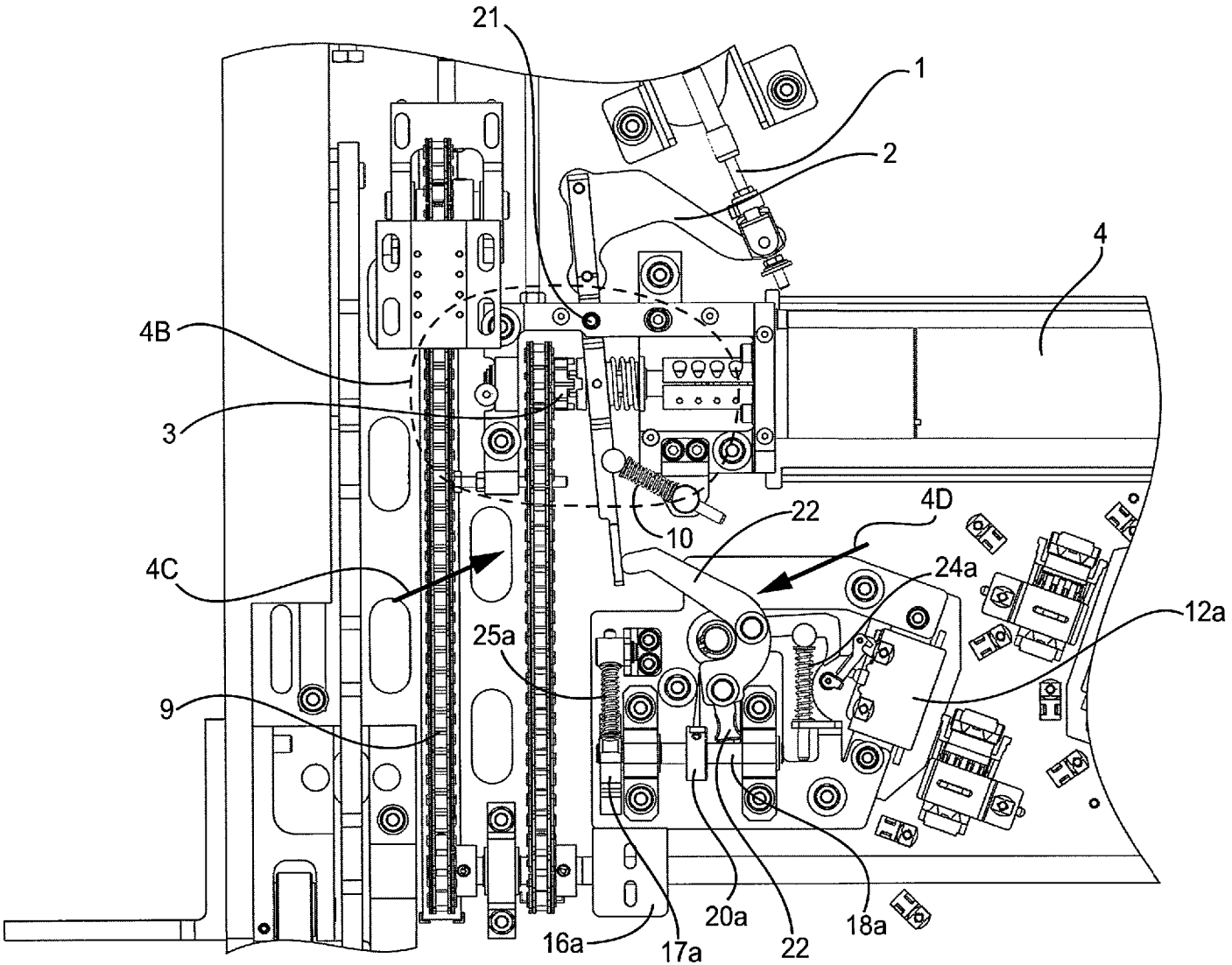
FIG. 4A shows the cutout lever in the neutral position with the push-pull cable at a second partially retracted position, the drive mechanism clutch disengaged, and the cutout lock arm disengaged.
Figure 4B:
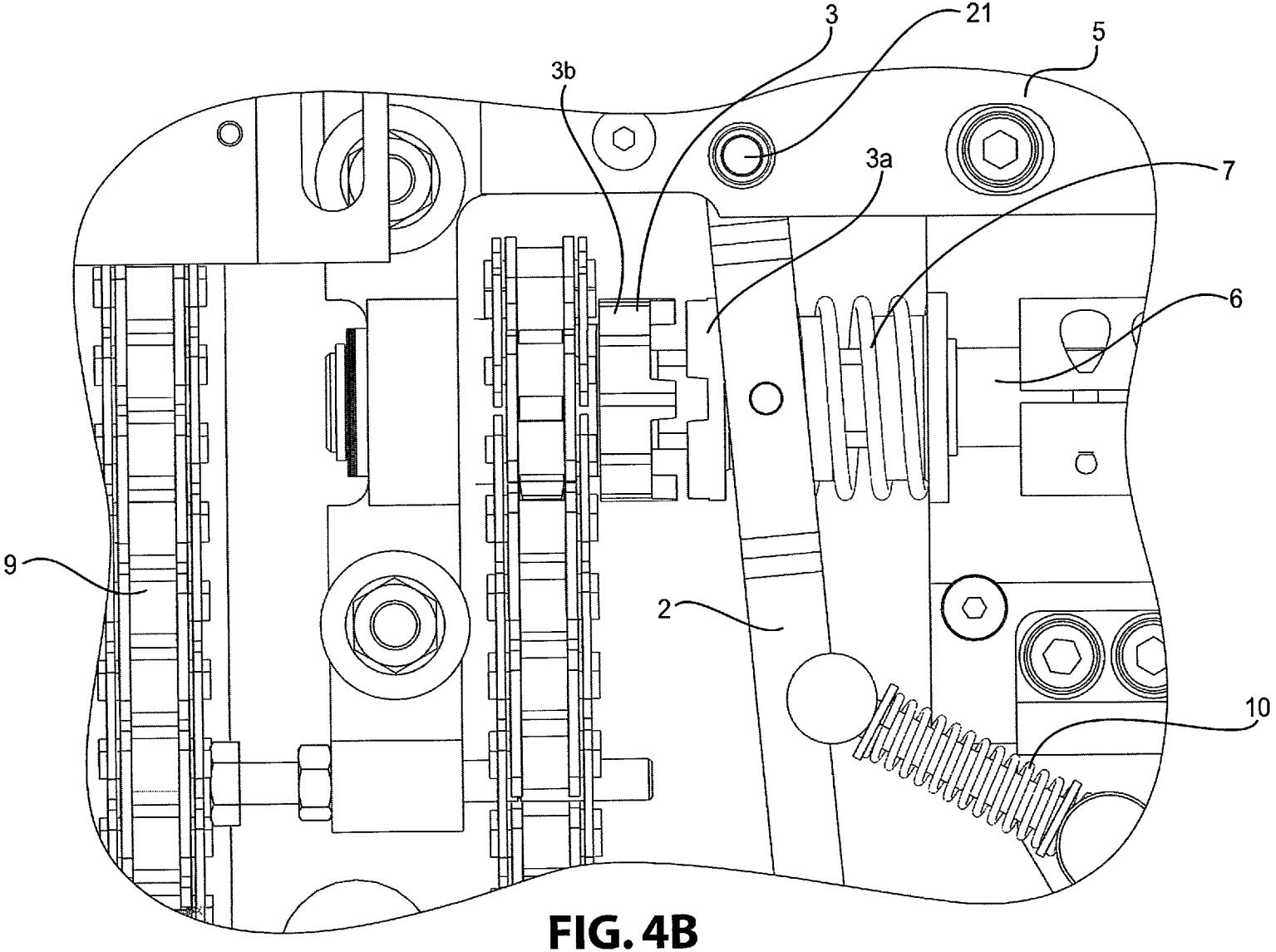
FIG. 4B illustrates an enlarged portion of the region encircled in FIG. 4A marked "4B" with a close-up of the motor drive clutch disengaged.
Figure 4C:
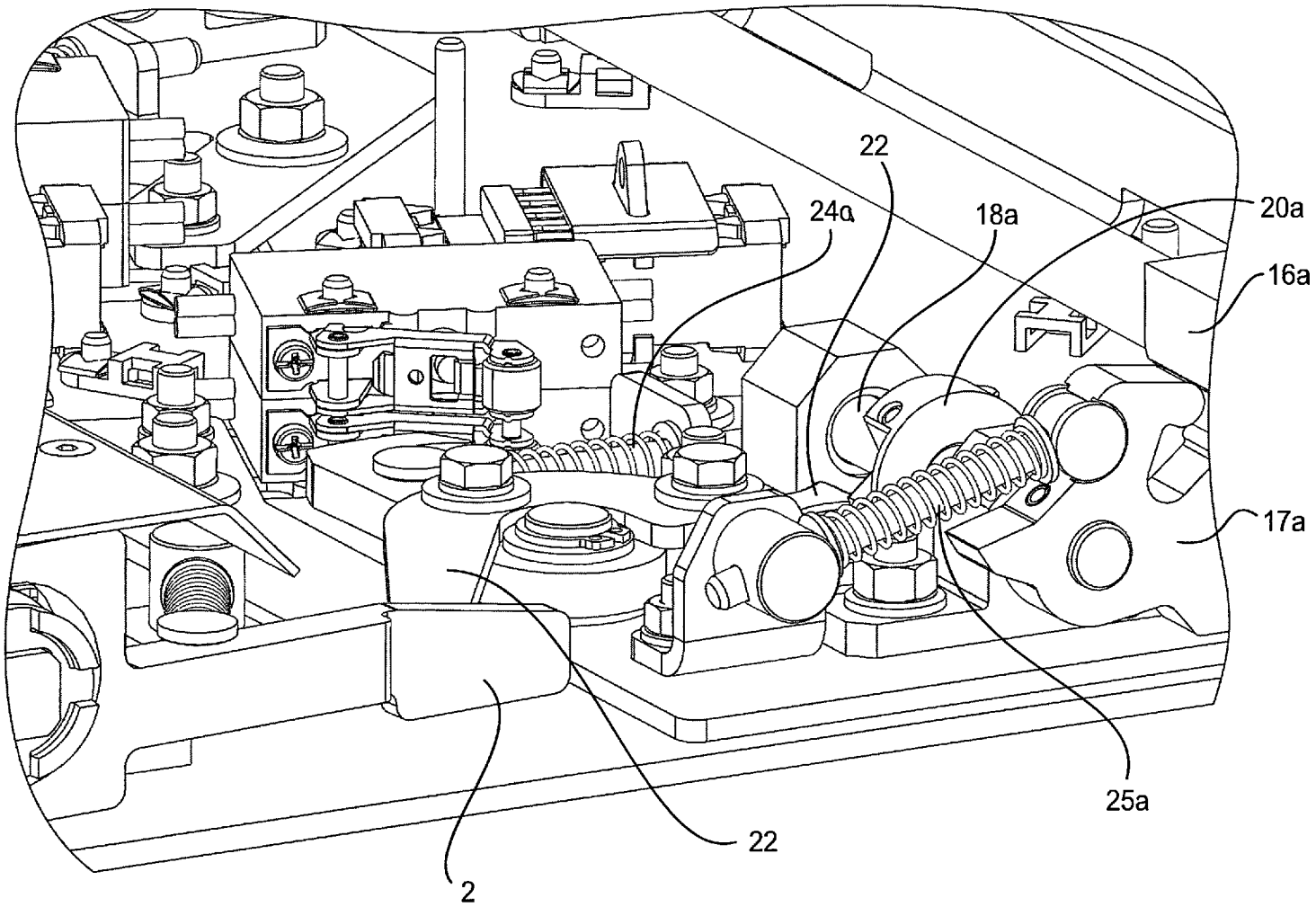
FIG. 4C illustrates a view along arrow 4C in FIG. 4A showing the cutout lock in the disengaged state.
Figure 4D:
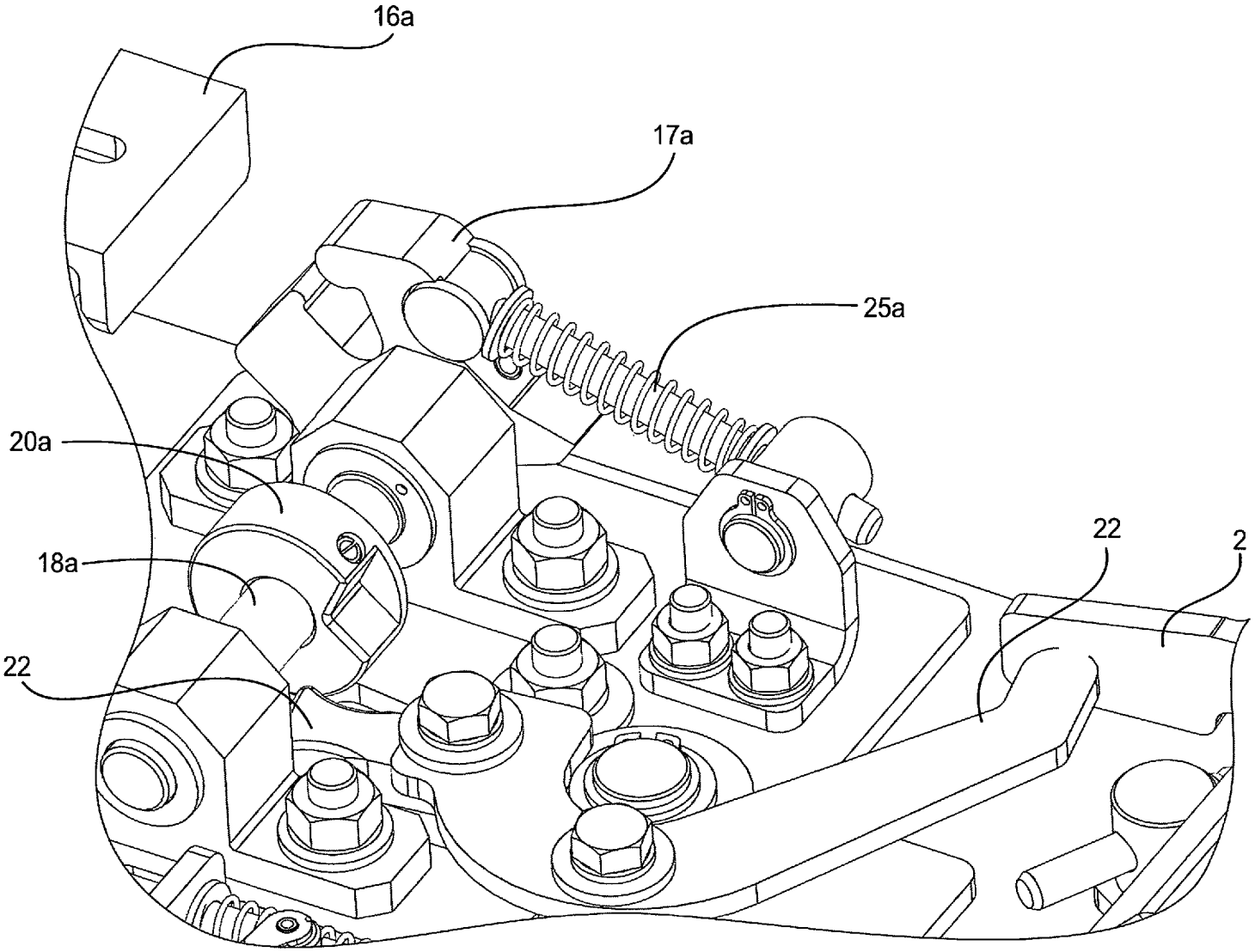
FIG. 4D illustrates the view along arrow 4D in FIG. 4A also showing the cutout lock in the disengage state.

Briefly directing attention to FIG. 4B, the clutch 3 is located between the motor assembly and the drive and is comprised of a first spring-loaded gear 3*a* on the motor side and a second meeting gear 3*b* on the drive side. The two gears 3*a*, 3*b* are normally maintained in an engaged position by the action of the clutch spring 7 and disengaged by the action of the cutout lever arm 2 when the cutout lever arm 2 in rotation pushes on the first gear 3*a* against the spring 7. A coupling shaft 6 supports the clutch spring 7 and the first gear 3*a* which are slidably mounted on the coupling shaft 6.

Returning to FIG. 3, the cutout lever arm 2 has its driving side mechanically coupled to the drive mechanism clutch 3 located between the motor assembly 4 and the rest of the drive so that a rotation to a first angle of the cutout lever arm 2 with respect to initial NORMAL position (FIG. 3) and corresponding to the push-pull cable 1 second position NEUTRAL will disengage the clutch 3, as shown in FIGS. 4A & 4B.

So far in FIG. 3 (NORMAL) and FIG. 4A (NEUTRAL), the cutout lever 2 has not actuated the cutout lock lever 22.

Figure 5A:
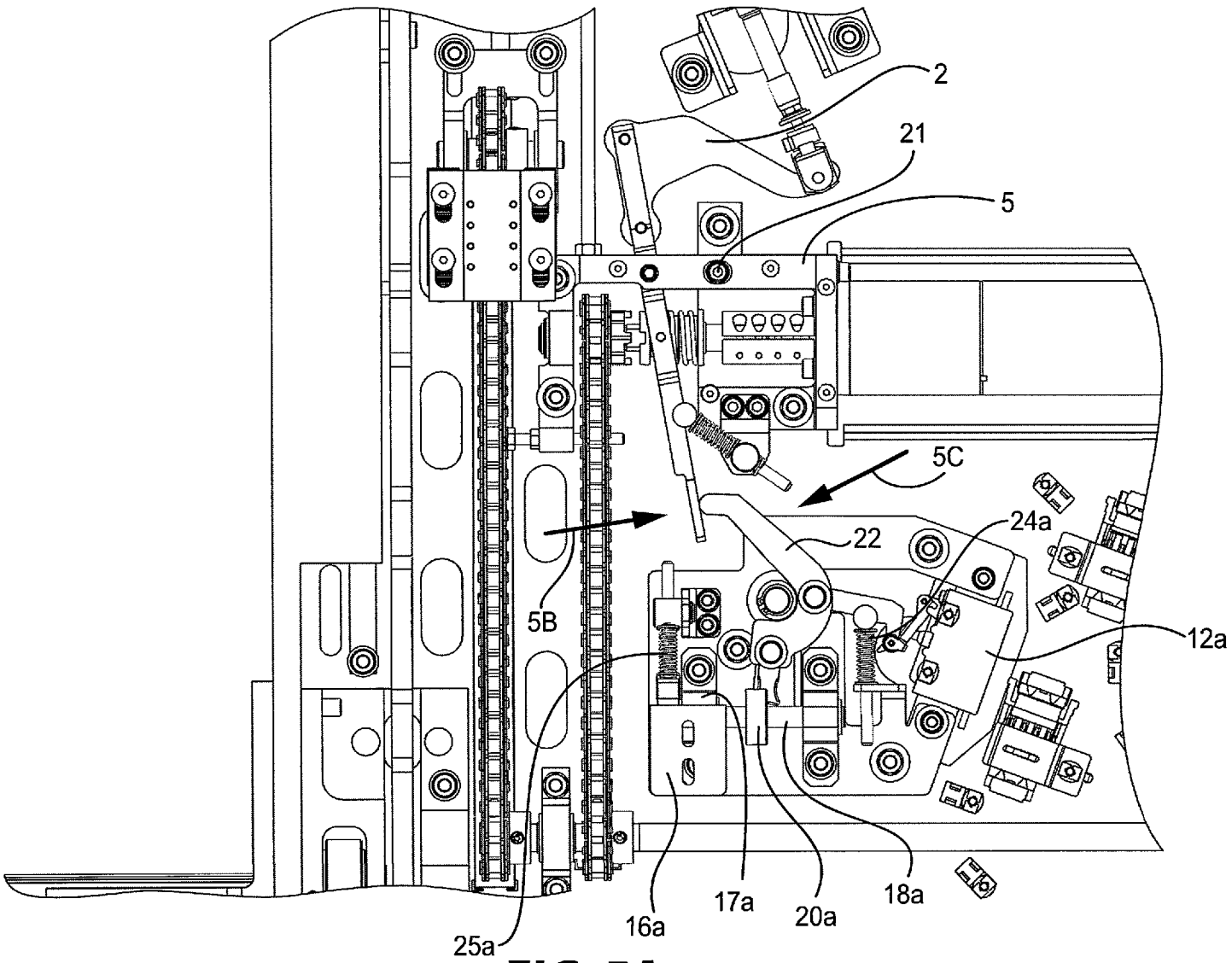
FIG. 5A shows the cutout lever in the cutout position with the push-pull cable at a third completely retracted "cutout" position, the drive mechanism clutch disengaged, and the cutout lock arm engaged.

Returning to FIG. 3, the cutout lever arm 2 has its driving side mechanically coupled at its tip to a cutout lock lever 22, associated with the first locking mechanism A, so that a rotation of the cutout lever arm 2 to a second angle greater than the first angle and corresponding to the push-pull cable 1 third position CUTOUT, the cutout lever arm 2 will engage the cutout lock lever 22, as shown FIG. 5A.

The cutout lever arm bias spring 10 is compressed by the driving end of the cutout lever arm 2 when the device is in the NEUTRAL position or the CUTOUT position. The cutout lever arm bias spring 10 pushes on the driving end of the cutout lever arm 2 to bring the device back to the normal position when the push-pull cable 1 is brought back to this position.

Figure 5B:
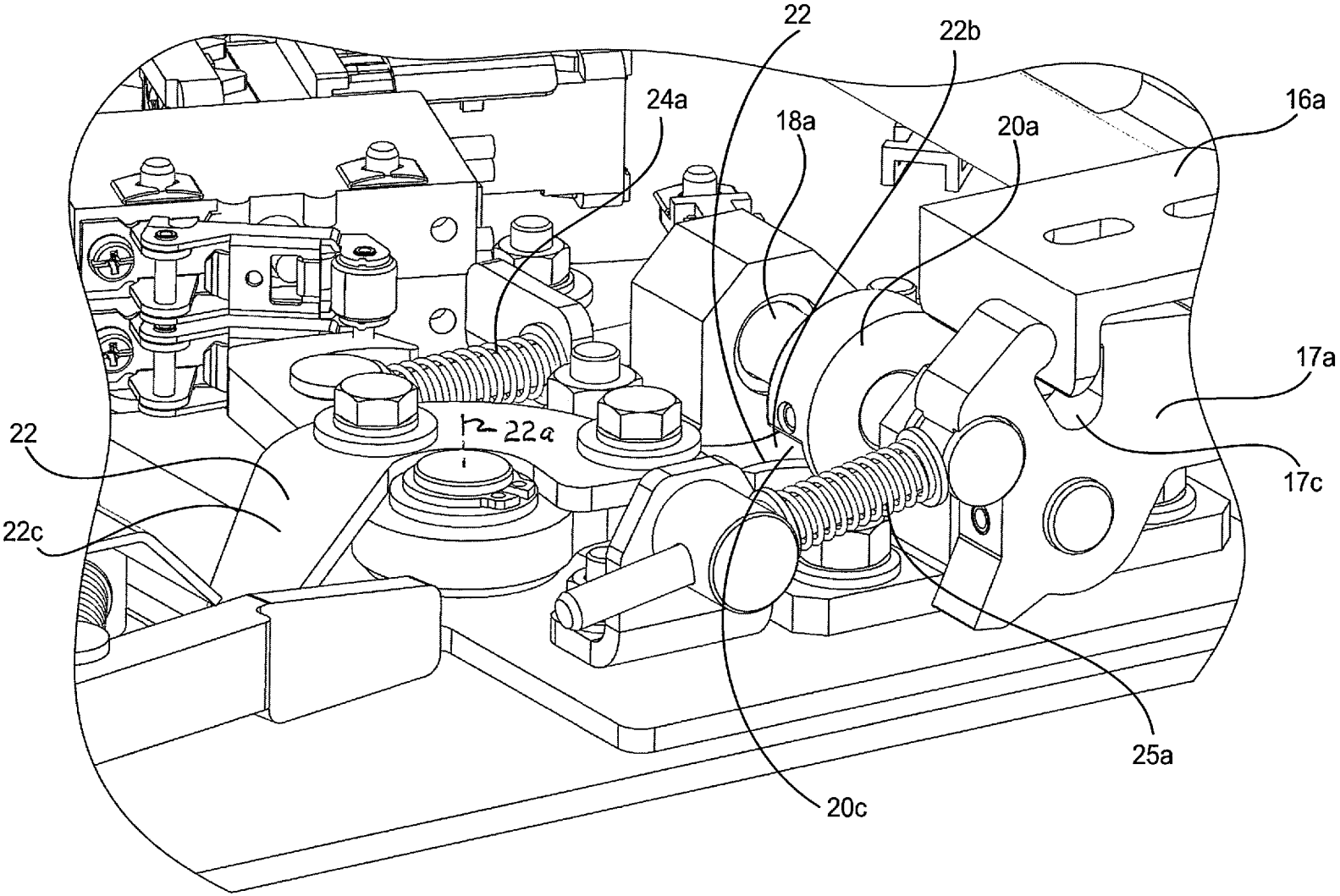
FIG. 5B illustrates a perspective view along arrow 5B in FIG. 5A with the cutout lock in the engaged state.
Figure 5C:
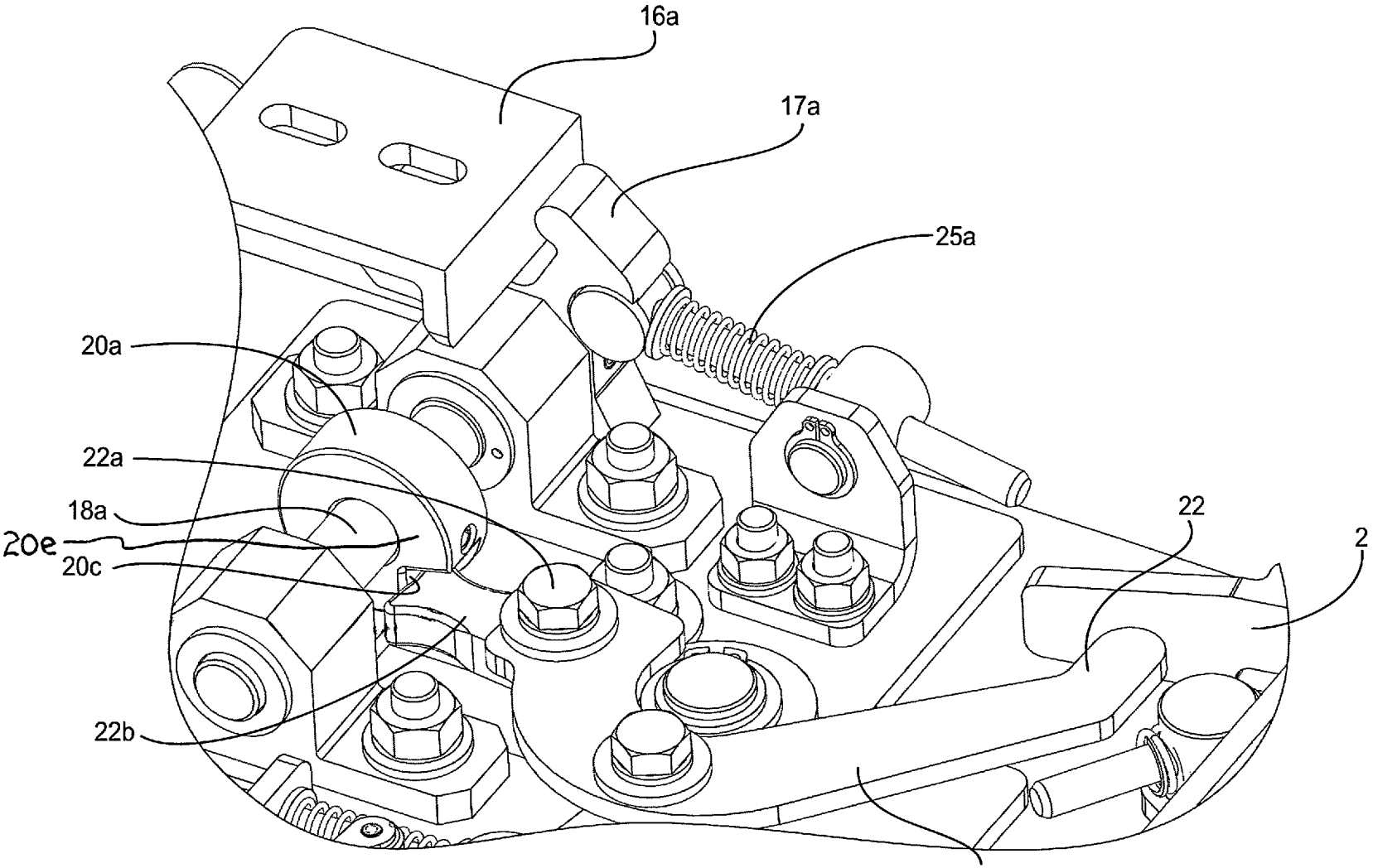
FIG. 5C is a view along arrow 5C in FIG. 5A showing the cutout lock in the engaged state.

FIGS. 5A-5C show the contact lever arm 2 in the cutout position. When the cutout lock lever 22 is actuated by the tip of the cutout lever arm 2, the end of the cut out lock lever 22 engages in the first notch 20*c* of the first shaft blocker 20*a* when actuated. As shown in FIGS. 5B and 5C, the cutout lock lever 22 is a two-wing L-shaped member with a rotator axis 22*a* at the junction of the two wings 22*b*, 22*c*. The tip of the first wing 22*b* is set to engage in the first notch 20*c* of the first shaft blocker 20*a* when lined up. The second wing

22*c* is used to compress the cutout lock lever bias spring 24*a* (FIG. 5B) by action of the cutout lever arm 2 when engaging the cutout lock lever 22.

Still directing attention to FIGS. 5B and 5C, the cutout first lock catch 17*a* is engaged by a first angle member 16*a* fastened to the gap mitigation plate 14 (FIG. 1), having a component in the vertical plane at right angle to the gap mitigation plate 14 inboard-outboard movement, whereby the engagement in the lock catch 17*a* occurs when the gap mitigation plate 14 reaches the stowed position. This engagement causes a rotation of the first lock catch 17*a* and the cutout lock shaft 18*a* about the axis of the cutout lock shaft 18*a* in turn causing a rotation of the first shaft blocker 20*a* about the same axis so that the first notch 20*c* lines-up with the first wing 22*b* of the cutout lock lever 22. At this point, the cutout lock lever 22 can be driven by the cutout lever arm 2 in the CUTOUT position, engaging the first wing 22*b* into the first notch 20*c*. The first shaft blocker 20*a* has, with the exception of the first notch 20*c*, has a circular flat surface 20*e* proximal to the tip of the first wing 22*b*. Interference with the tip of the first wing 22*b* by this circular flat surface 20*e* prevents this engagement when the first notch 20*c* is not lined-up with the first wing 22*b*, that is when the first angle member 16*a* is not fully engaged in the first lock catch 17*a*, that is when the gap mitigation plate is not completely stowed.

A cutout sensing switch 12*a* (FIG. 5A) senses the position of the cutout lock.

To provide additional details, the first angle member 16*a* is a bracket made of two surfaces substantially at right angles from one another and with a first surface fastened to the gap mitigation plate 14. The second surface of the first angle member 16*a* engages in the first groove 17*c* of the first lock catch 17*a* (FIGS. 5B and 5C).

The first lock catch 17*a* is mounted on and fastened to the cutout lock shaft 18*a*. The first lock catch 17*a* has a groove 17*c* which receives the first angle member 16*a* second surface.

The cutout lock shaft 18*a* is a rotating shaft with its rotation axis in a plane parallel to the mounting plate 8 and at a right angle with the motion of the gap mitigation plate 14 on to which are mounted and fastened the first locking catch 17*a* and the first shaft blocker 20*a*.

The second shaft blocker 20*b* is a disk mounted on and fastened to the solenoid lock shaft 18*b*. This disk has a notch allowing the tip of the solenoid lock lever to engage in the notch to restrict movement of the gap mitigation plate 14 through the second lock catch 17*b* and the second angle member 16*b*.

The cutout lock catch bias spring 25*a* is compressed by the rotation of the first lock catch 17*a* when the gap mitigation plate 14 is stowed. When the gap mitigation plate 14 is deployed, this spring pushes on the first lock catch 17*a* causing it to rotate about the cutout lock shaft 18*a*. The cutout lock catch bias spring 25*a* then maintains the first lock catch 17*a* in a position where the first angle member 16*a* can engage the first groove 17*c* of the first lock catch 17*a* when the gap mitigation plate 14 is moved to its stowed position.

The cutout lock lever bias spring 24*a* is a spring acting on the cutout lock lever 22. The cut out lock lever bias spring 24*a* is compressed by action of the cutout lever arm 2, when engaging the cutout lock lever 22. When these are not engaged, the spring pushes on the second wing 22*c* of the cutout lock lever 22, causing its rotation and causing the tip of the first wing 22*b* of the cutout lock lever 22 to disengage out of the notch of the first shaft blocker 20*a*, thus returning or maintaining the device in the non-cutout position.

Overall, the first shaft blocker 20*a* is secured directly to the cutout lock shaft 18*a*. The first lock catch 17*a* is also secured directly to the cutout lock shaft 18*a*. Therefore, when the cutout lock lever 22 engages the first notch 20*c* of the first shaft blocker 20*a*, the cutout lock shaft 18*a* cannot rotate. As a result, the first lock catch 17*a*, which has captured the first angle member 16*a*, cannot rotate and the first angle member 16*a* is locked in place preventing the gap mitigation plate 14, to which it is secured, from moving.

What has been described is the first locking mechanism B. The second locking mechanism C may also lock the gap mitigation plate 14. For the second locking mechanism C, a solenoid release lock is used and the locking is implemented by a second angle member 16*b* fastened to the gap mitigation plate 14. The second angle member 16*b* has a component in the vertical plane at right angle to the gap mitigation plate 14 inboard-outboard movement and for engaging in a second lock catch 17*b* when the gap mitigation plate 14 reaches the stowed position.

The second locking mechanism C operates in a similar manner to that of the first locking mechanism B.

The second lock catch 17*b* is a member mounted on and fastened to the solenoid lock shaft 18*b*. The second lock catch 17*b* has a groove 17*d* which receives the second angle member 16*b* second surface.

The second angle member 16*b* engaging the groove 17*d* of the second lock catch 17*b* causes a rotation of the lock catch 17*b* along with the solenoid lock shaft 18*b* and the second shaft blocker 20*b* until the notch 20*d* of the second lock shaft blocker 20*b*, which is a disk, lines-up with the solenoid lever 23. At this point, the compressed solenoid lever bias spring 24*b* causes the solenoid lever 23 to rotate about axis 23*b* of the solenoid lever 23 and engage its tip into the second shaft blocker notch 20*d*. The solenoid lever 23 is biased in the locked position and is released by the activation of the solenoid 19 retracting its arm 19*a* when energized.

Figure 6A:
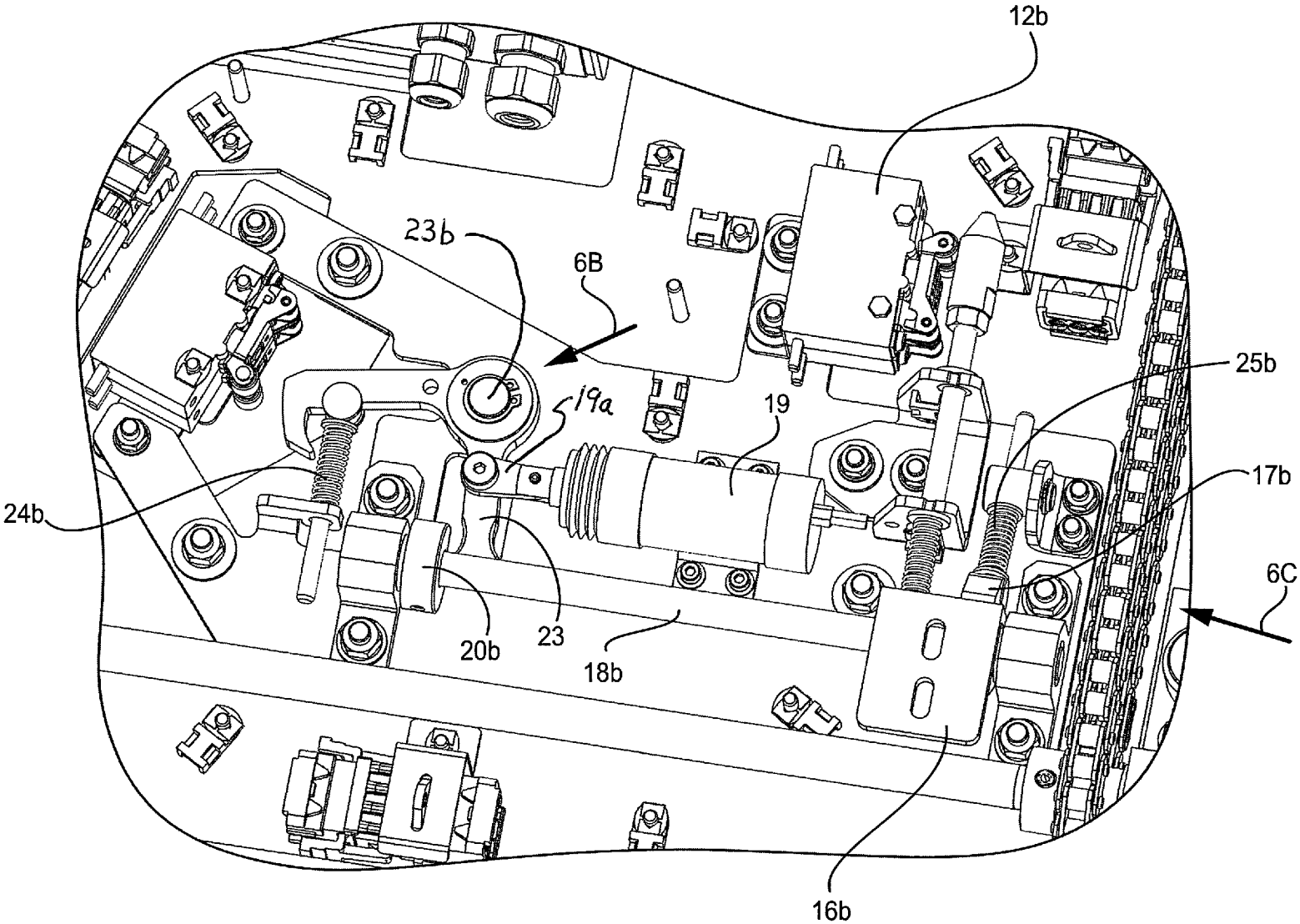
FIG. 6A shows the solenoid-release lock in an unlocked position with the lock catch ready to receive the angle plate to lock the GMD in the stowed position.
Figure 6B:
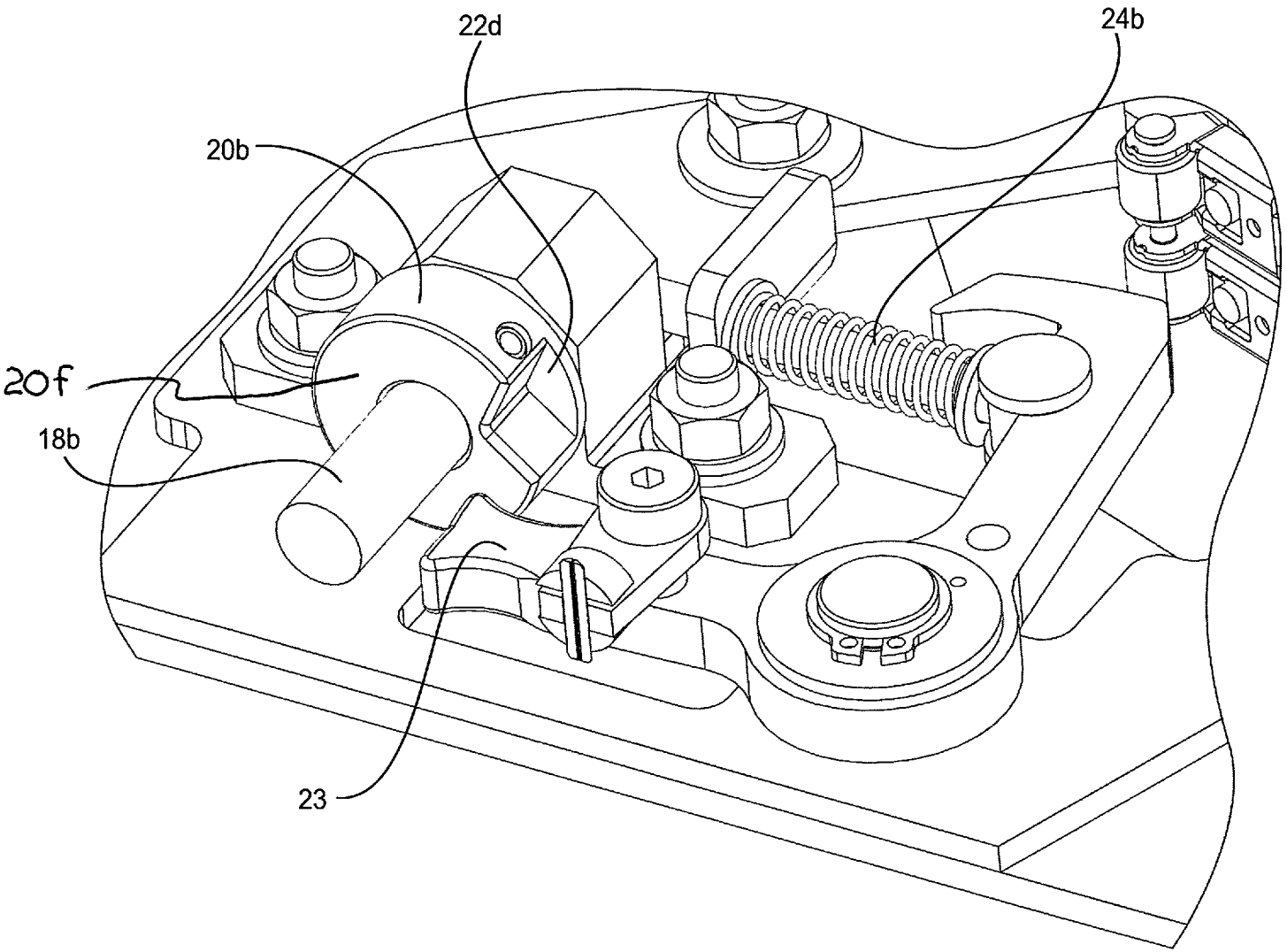
FIG. 6B is a view along arrow 6B in FIG. 6A.
Figure 6C:
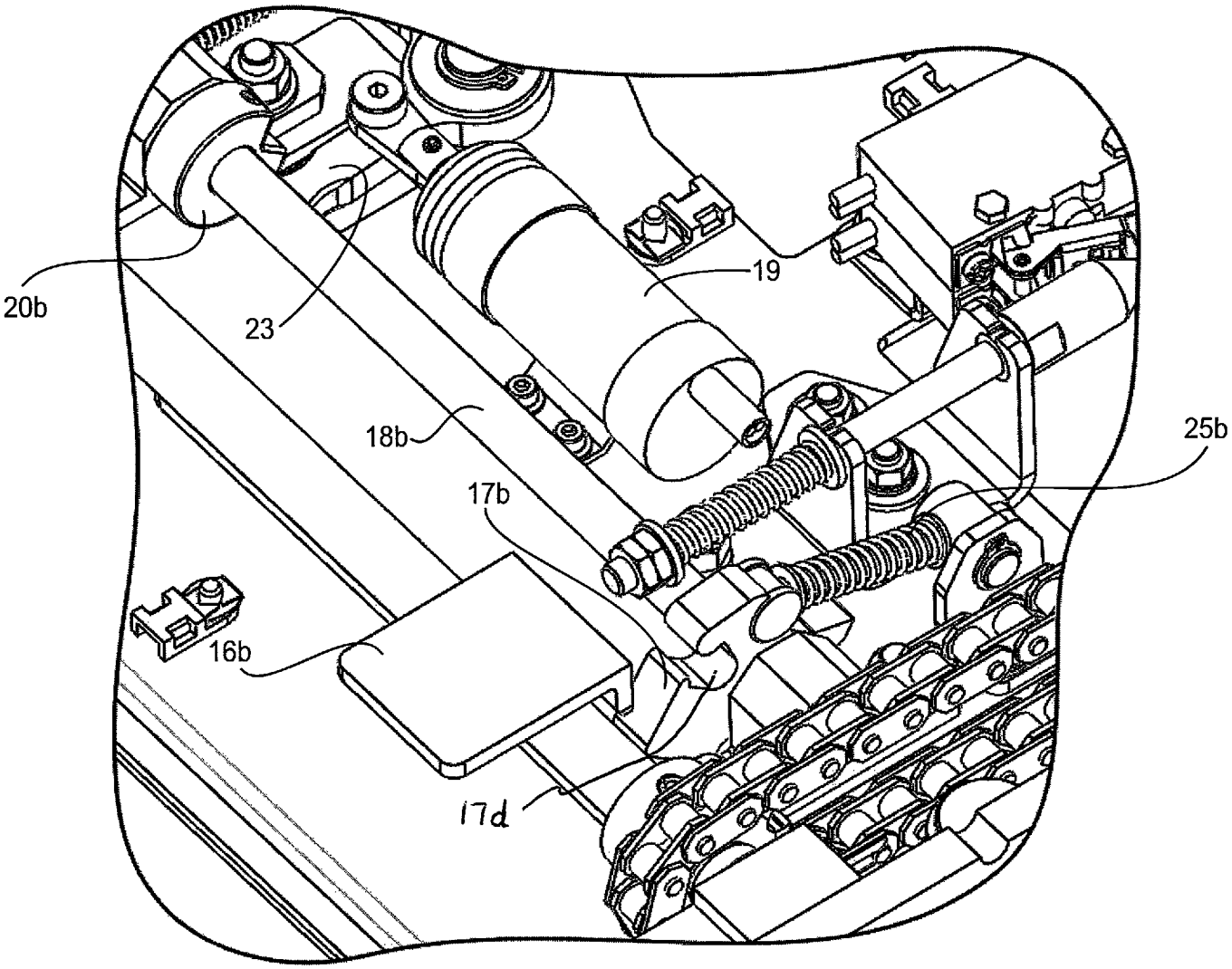
FIG. 6C is a perspective view along arrow 6C in FIG. 6A.
Figure 7A:
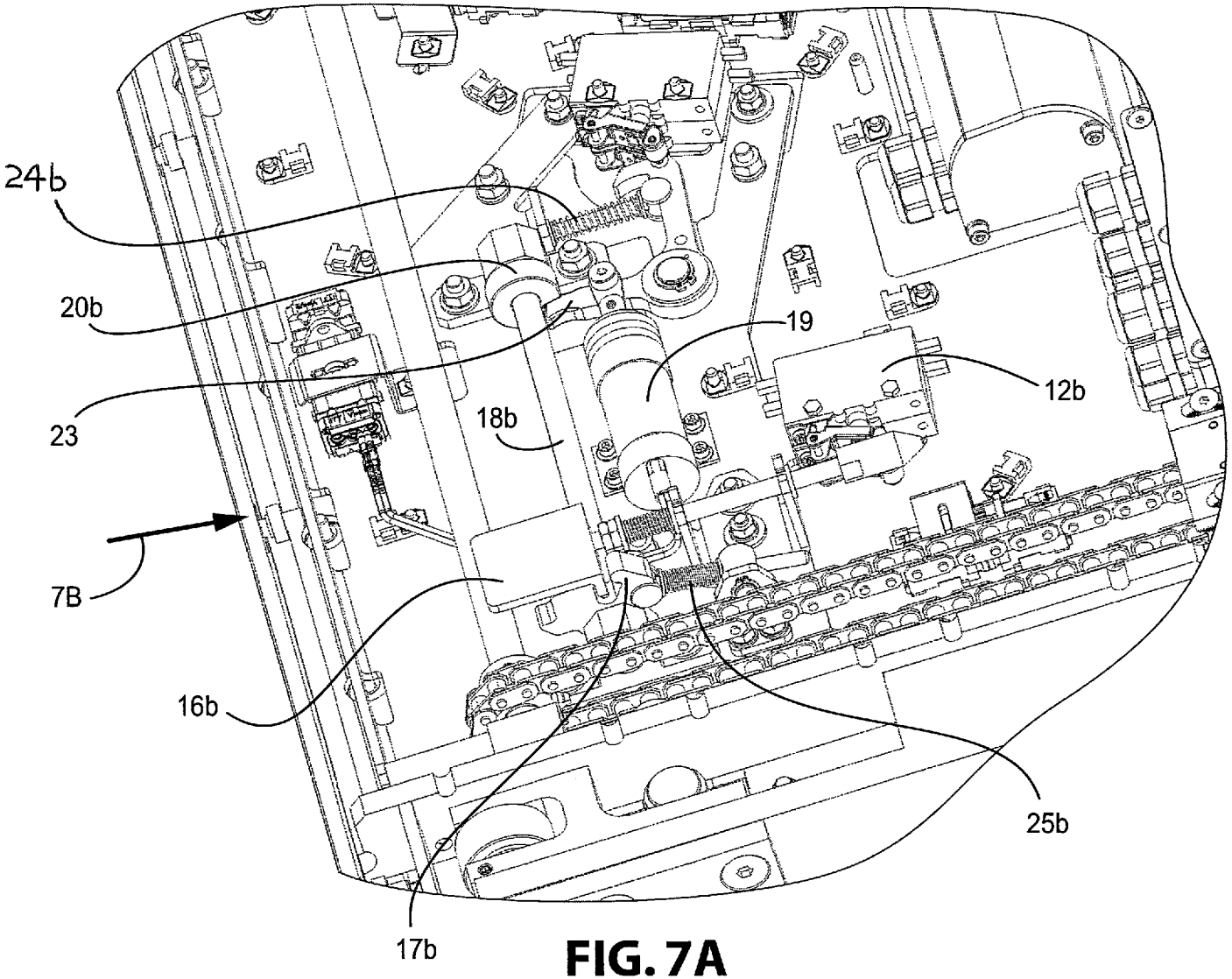
FIG. 7A illustrates the solenoid-release lock in locked position with the lock catch restraining movement of the angle plate.
Figure 7B:
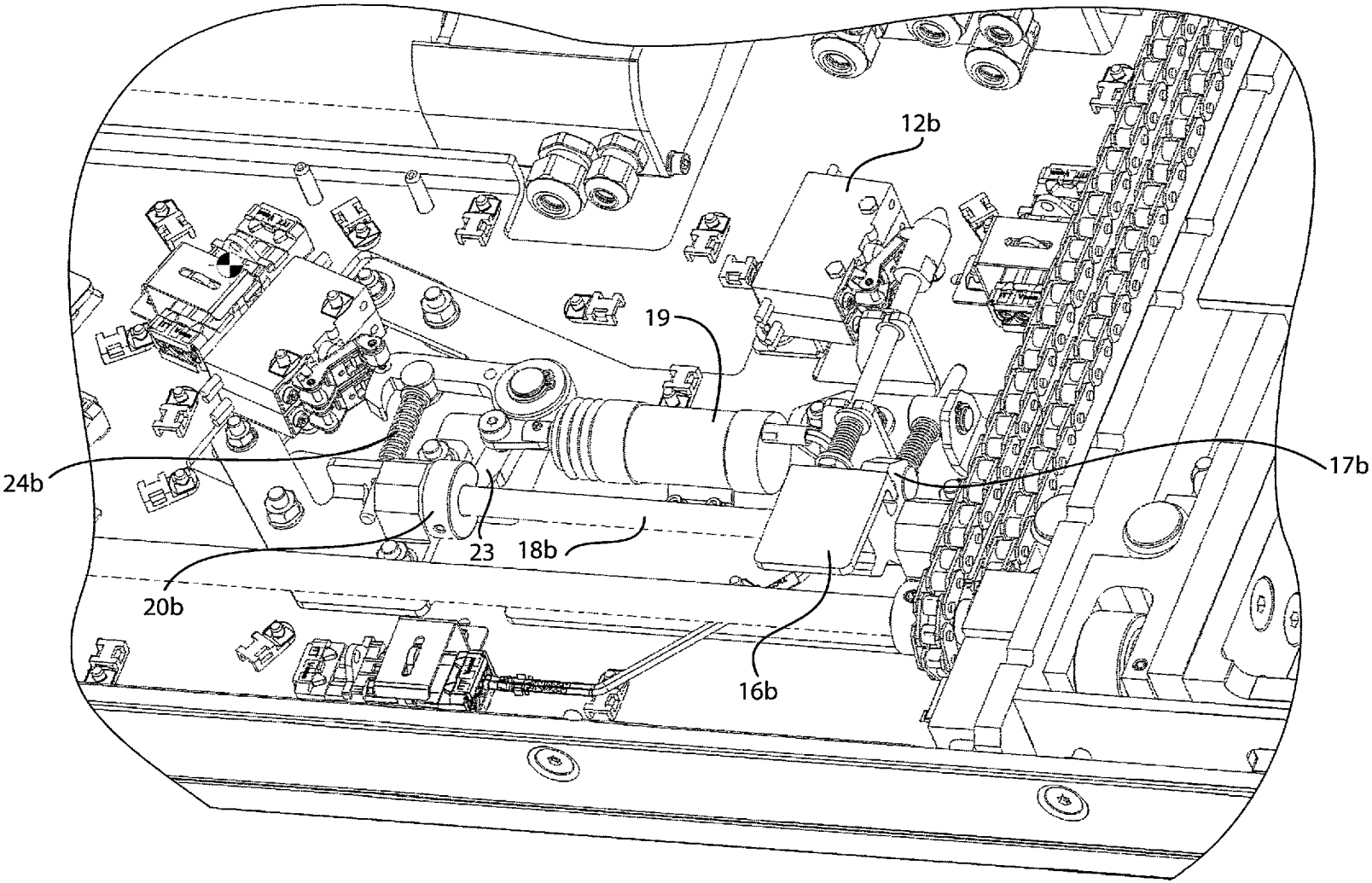
FIG. 7B is a view of FIG. 7A at a different orientation.

Just as with the first angle member 16*a*, the second angle member 16*b* is a bracket made of two surfaces substantially at right angles (FIG. 6C) from one another with the first surface fastened to the gap mitigation plate 14 and a second surface engaging in the second groove 17*d* of the second lock catch 17*b*. Since the second lock catch 17*b* is secured to the same solenoid lock shaft 18*b* to which the second shaft blocker 20*b* is secured, when the second shaft blocker 20*b* is locked, the shaft 18*b* cannot rotate. As illustrated in FIGS. 7A and 7B, when the second shaft blocker 20*b* is locked, then the shaft 18*b* cannot rotate. If the shaft 18*b* cannot rotate, then the second lock catch 17*b* cannot rotate. Since the second angle member 16*b* is retained by the second lock catch 17*b*, then the gap mitigation plate 14, to which the second angle member 16*b* is attached, cannot move in the direction of travel.

To provide additional detail, the solenoid lock shaft 18*b* is a rotating shaft with its rotation axis in a plane parallel to the mounting plate 8 and at a right angle with a motion of the gap mitigation plate 14 onto which are mounted and fastened the second lock catch 17*b* and the second shaft blocker 20*b*. This prevents any rotation of the solenoid lock shaft 18*b* and thus the second lock catch 17*b* which in turn locks the gap mitigation plate 14 in the stowed position.

To release the solenoid lever 23, the solenoid release lock has a solenoid 19 linked to the lock catch shaft 18*b* via a solenoid arm 19*a* itself linked to a solenoid lever 23 and second shaft blocker 20*b* and which when electrically actuated retracts the solenoid arm 19*a* which releases the second shaft blocker 20*b* and allows rotation of the lock catch so that the second angle member 16*b* is free to move outboard when the gap mitigation plate 14 is deployed.

The solenoid 19 is an electric device actuating the solenoid release lock. The preferred embodiment of this utilizes a linear solenoid, however, it is also possible to utilize a rotary solenoid.

A solenoid lock sensing switch 12*b* senses the position of the solenoid lock.

In general, the motor assembly 4 is fitted with a gearbox having a high gear ratio and an electric motor which has its winding electrically shorted once the gap mitigation plate is deployed. This arrangement actually creates a very high mechanical resistance to manually driven movements of the gap mitigation plate 14 either inboard or outboard, acting as a lock when in the deployed position.

Just as with the cutout lock shaft 18*a*, the solenoid lever 23 is a two-wing L-shaped member with a rotation axis 23*b* at the junction at the two wings. The lever rotates by the action of the solenoid 19. The tip of the first wing 22*b* is set to engage in the notch of the second shaft blocker 20*b* when lined up. The second wing 22*d* is used to compress the solenoid lever bias spring 24*b* when set in the unlocked position by action of the solenoid 19 when energized. When the solenoid 19 is not energized, the solenoid lock lever is pushed towards the locked position by action of the solenoid lever by a solenoid lever bias spring 24*b*. However, the tip of the solenoid lever 23 can only engage the notch 20*d* of the second shaft blocker 20*b* when this tip is lined-up with the notch 20*d* i.e. when the gap mitigation plate 14 is fully stowed. If these two components are not lined-up, the tip of the solenoid lever 23 will rest against the circular flat surface 20*f* of the second shaft blocker 20*b* by action of the solenoid lever bias spring 24*b*.

The solenoid lever bias spring 24*b* is a spring acting on the second wing of the solenoid lever 23. This spring is compressed by action of the solenoid 19, when energized. When the solenoid 19 is not energized, the spring pushes on the second wing of the solenoid lever, causing its rotation and causing the tip of the first wing of the solenoid lever 23 to engage in the notch of the second shaft blocker 20*b* when lined up.

The solenoid lock catch bias spring 25*b* is compressed by the rotation of the second lock catch 17*b* when the gap mitigation plate 14 is stowed. When the solenoid lock 25*b* is released and the gap mitigation plate 14 is deployed, this spring pushes on the second lock catch 17*b* causing it to rotate about the solenoid lock shaft 18*b* axis. It then maintains the second lock catch 17*b* in a position so that the second angle member 16*b* can engage the groove of the second lock catch 17*b* when the gap mitigation plate 14 is moved to its stowed position.

The drive mechanism 9 (FIG. 2) is used for transferring rotary motion of the motor assembly comprised of the clutch 3 and a driving means to a linear motion of the gap mitigation plate 14. In a preferred embodiment of the invention, the driving mechanism 9 is a chain and sprocket arrangement tied to the gap mitigation plate 14 at one link of the chain. Other driving means are possible so long as they can be manually back driven by application of a low force for manual stowage purposes.

The components of the gap mitigation device are all substantially laid-out and assembled on a single planar mounting plate 8.

The GMD described herein has a clutch 3 to disengage the motor drive which allows for a very low manual stowage force. The magnitude of this force depends on the specific drive mechanism employed. In the case of the preferred embodiment, the force is typically around 25 lbs for a 50 inch-wide by 8 inch stroke of the gap mitigation plate. The same lever actuating the clutch also actuates the cutout lock resulting in a simplified cutout process. The compact layout has provided a 50 mm overall thickness in a preferred embodiment. Furthermore, the GMD described herein provides for easier installation on a car due to mechanical packaging based on a "cartridge" concept and simpler cutout operation.

This design provides a modular, compact, low profile powered gap mitigation device having a low-profile drive mechanism along with means of locking the device in both the stowed and the deployed position, a means of remotely cutting out the device in case of malfunction, and a low manual stowage force to retract the device in case of malfunction or loss of power.

This design also provides a unique physical arrangement of mechanical and electromechanical components which are essentially planar to achieve a low profile and compactness. This arrangement also includes all components to provide the required locking and cutout-related functions.

While certain embodiments of the invention are shown in the accompanying figures and described herein above in detail, other embodiments will be apparent to and readily made by those skilled in the art without departing from the scope and spirit of the invention. For example, it is to be understood that this disclosure contemplates that to the extent possible, one or more features of any embodiment can be combined with one or more features of the other embodiment. Accordingly, the foregoing description is intended to be illustrative rather than restrictive.

The invention claimed is:

1. A low profile powered gap mitigation device for transit vehicles allowing a gap mitigation plate through a clutch linkage driven by a motor to move back and forth between a stowed position and a deployed position and to be locked in either position, wherein the device comprises:

a cutout mechanism operated entirely manually which:

a) in a normal position engages the clutch with the motor to move the plate;

b) in a neutral position disengages the clutch from the motor; and c) in a cutout position disengages the clutch from the motor and locks the plate in the stowed position.

2. The gap mitigation device according to claim 1, wherein the cutout mechanism is comprised of a single lever attached to a push-pull cable linked to a cutout lever arm to provide the three operational positions.

3. The gap mitigation device according to claim 2, wherein the cutout lever arm is rotatably mounted on a block fastened to a planar mounting plate, wherein a driven side of the cutout lever arm comprises a linkage to the push-pull cable to rotate the arm and wherein an opposite driving side of the cutout lever comprises a portion that engages and disengages the clutch and also a portion that engages the cutout lever lock of a first locking mechanism to lock the plate in the stowed position, whereby pulling on the cable will cause the cutout lever arm to rotate around its mounting point on the block.

4. The gap mitigation device according to claim 3, wherein in the cutout position, the cutout lock lever engages a first shaft blocker mounted on a cutout lock shaft onto which a first lock catch is also mounted to prevent movement of the plate.

5. The gap mitigation device according to claim 4, wherein the first shaft blocker has a first notch and a circular surface surrounding the first notch such that the cutout lever contacts the circular surface when the plate is moving and only engages the first notch to prevent movement of the plate when the plate is in the stowed position.

6. The gap mitigation device according to claim 4, wherein the cutout lock lever is biased by a spring in the unlocked position.

7. The gap mitigation device of claim 6, wherein the first lock catch is engaged by a first angle member fastened to the gap mitigation plate, wherein the first angle member has a component in the vertical plane at right angle to the gap mitigation plate inboard-outboard movement and wherein the engagement in the first lock catch occurs when the gap mitigation plate reaches the stowed position.

8. The gap mitigation device of claim 3, further including a second locking mechanism comprised of a solenoid-release lock, the solenoid release lock being implemented by a second angle member fastened to the gap mitigation plate, wherein the second angle member has a component in the vertical plane at right angle to the gap mitigation plate inboard-outboard movement and engaging in a second lock catch when the gap mitigation plate reaches the stowed position.

9. The gap mitigation device of claim 8, wherein the second locking mechanism further comprises a solenoid linked to the second lock catch via a solenoid lever, a second shaft blocker and a solenoid lock shaft and which when electrically actuated causes a rotation of the solenoid lever which releases the shaft blocker and allows rotation of the lock catch about the axis of the solenoid lock shaft so that the second angle member is free to move outboard when the gap mitigation plate is deployed.

10. The gap mitigation device according to claim 9, wherein the second shaft blocker has a second notch and a circular flat surface surrounding the second notch such that the solenoid lever contacts the circular flat surface when the plate is moving and only engages the second notch to prevent movement of the plate when the solenoid is actuated and the plate is in the stowed position.

11. The gap mitigation device according to claim 9, wherein the solenoid lever is biased in the locked position and compresses a bias spring by action of the solenoid when the solenoid is energized.

12. The gap mitigation device of claim 1, wherein the motor is part of a motor assembly comprising a gearbox with a high gear ratio and the motor which is electric and has its winding electrically shorted once the gap mitigation plate is deployed.

13. The gap mitigation device of claim 1, wherein each component is mounted upon a common single planar plate to provide a relatively compact profile.

14. The gap mitigation device according to claim 1, wherein in the neutral position, the second locking mechanism is activated to lock the plate in the stowed position when the clutch is disengaged.

15. The gap mitigation device according to claim 1, wherein in the neutral position prior to activation of the second locking mechanism, the plate is free to move between the stowed and deployed positions.

16. The gap mitigation device according to claim 2, wherein the cutout lever arm is biased in the normal position.

17. The gap mitigation device according to claim 8, wherein each of the first locking mechanism and the second locking mechanism has sensors to determine their unlocked/locked positions with respect to the plate.

18. In a low profile powered gap mitigation device for transit vehicles allowing a gap mitigation plate through a clutch linkage driven by a motor to move back and forth between a stowed position and a deployed position and to be locked in either position, a method for introducing three positions of the plate using a single cutout mechanism comprising the steps of:

a) manually moving a lever to a normal position to engage the clutch with the motor to move the plate;

b) manually moving the same lever to a neutral position to disengage the clutch from the motor; and c) manually moving the same lever to a cutout position to disengage the clutch from the motor and at the same time activate a first locking mechanism to lock the plate in the stowed position.

19. The method of claim 18, further including the step at the same time or after the step manually moving the lever to the neutral position of activating a second locking mechanism to lock the plate in the stowed position.

* * * * *